US005193420A

United States Patent [19]

Smith

[11] Patent Number: 5,193,420

[45] Date of Patent: Mar. 16, 1993

[54] LOCKING LUG REMOVAL TOOL

[76] Inventor: Charles T. Smith, 2730 Fernwood St., Roseville, Minn. 55113

[21] Appl. No.: 825,566

[22] Filed: Jan. 24, 1992

[51] Int. Cl.[5] ..... B25B 23/10

[52] U.S. Cl. ..... 81/442; 81/185; 81/461

[58] Field of Search ..... 81/185, 442, 461, DIG. 11

[56] References Cited

U.S. PATENT DOCUMENTS 3,674,070 7/1972 Mahoney ..... 81/442
3,698,267 10/1972 Denney ..... 81/185
4,887,498 12/1989 Zayat ..... 81/185

*Primary Examiner*—James G. Smith
*Attorney, Agent, or Firm*—Hugh E. Smith

[57] ABSTRACT

A tool is arranged with a first housing coaxially mounted in longitudinal alignment with a second housing, with a matrix of block pins extending in a spring-biased relationship from the first housing into the second housing, wherein the lock pins are arranged for displacement and retraction into the first housing to accommodate various recesses relative to a locking lug as typically utilized with a vehicular wheel.

5 Claims, 4 Drawing Sheets

29

29

22
22

30

30

23
23

LOCKING LUG REMOVAL TOOL

BACKGROUND OF THE INVENTION

1. Field of the Invention

The field of invention relates to locking lug tools, and more particularly pertains to a new and improved locking lug removal tool wherein the same is arranged for the removal of locking lugs relative to a vehicular wheel.

2. Description of the Prior Art

Prior art locking lug structure is exemplified by the U.S. Pat. No. 4,869,633 to Hayashi wherein a locking lug member is formed with a uniquely configured side wall construction to be received within a complementarily configured cavity of an associated removal tool.

U.S. Pat. No. 4,825,669 to Herrera sets forth a wheel lug nut cover utilizing a key lock to secure the nut cover thereto.

U.S. Pat. No. 4,625,599 to Icard sets forth fixed lugs mounted to a first end of a tool to be received within recesses of a second tool to provide for extension of the tool structure.

As such, it may be appreciated that there continues to be a need for a new and improved locking lug removal tool as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of locking lug removal tools now present in the prior art, the present invention provides a locking lug removal tool wherein the same utilizes telescopingly mounted pins mounted within a locking lug removal tool to accommodate various recesses within a locking lug member relative to an associated vehicular wheel. As such, the general purpose of the present invention, which will be described subsequently in greater detail, is to provide a new and improved locking lug removal tool which has all the advantages of the prior art removal tool apparatus and none of the disadvantages.

To attain this, the present invention provides a tool arranged with a first housing coaxially mounted in longitudinal alignment with a second housing, with a matrix of lock pins extending in a spring-biased relationship from the first housing into the second housing, wherein the lock pins are arranged for displacement and retraction into the first housing to accommodate various recesses relative to a locking lug as typically utilized with a vehicular wheel.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved locking lug removal tool which has all the advantages of the prior art locking lug apparatus and none of the disadvantages.

It is another object of the present invention to provide a new and improved locking lug removal tool which may be easily and efficiently manufactured and marketed.

It is a further object of the present invention to provide a new and improved locking lug removal tool which is of a durable and reliable construction.

An even further object of the present invention is to provide a new and improved locking lug removal tool which is susceptible of a low cost of manufacture with regard to both materials and labor, and which accordingly is then susceptible of low prices of sale to the consuming public, thereby making such locking lug removal tools economically available to the buying public.

Still yet another object of the present invention is to provide a new and improved locking lug removal tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
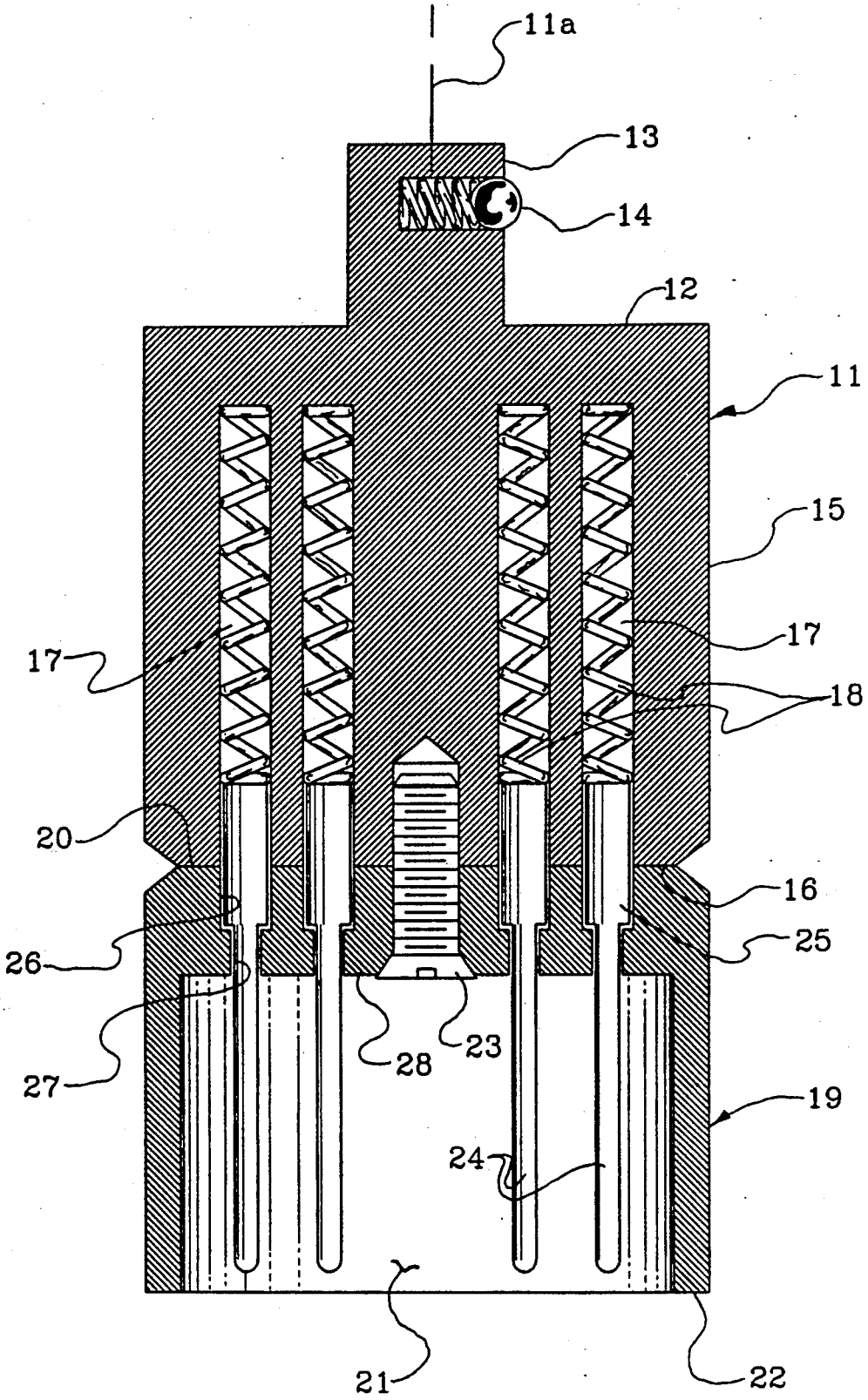
FIG. 1 is an orthographic cross-sectional illustration of the tool structure of the invention.
Figure 2:
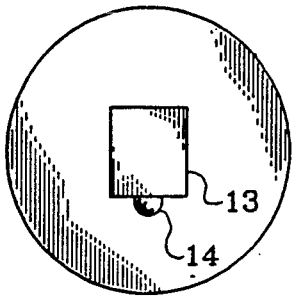
FIG. 2 is an orthographic top view of the instant invention.
Figure 4:
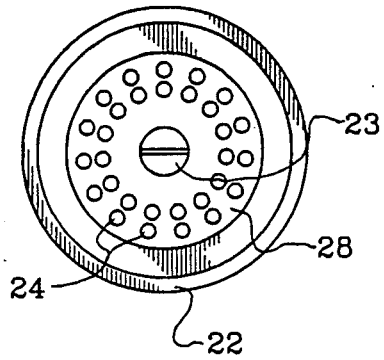
FIG. 4 is an orthographic bottom view of the instant invention.
Figure 3:
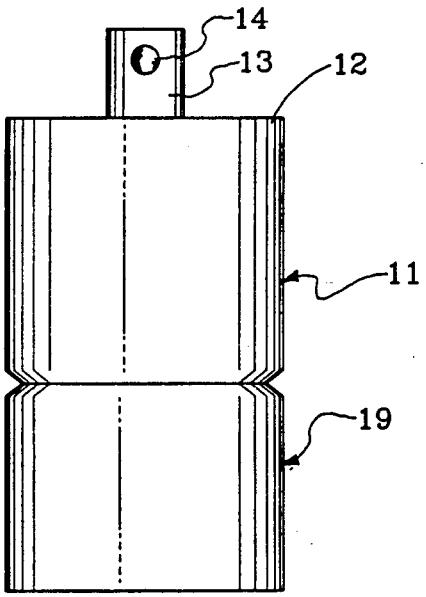
FIG. 3 is an orthographic side view of the instant invention.
Figure 5:
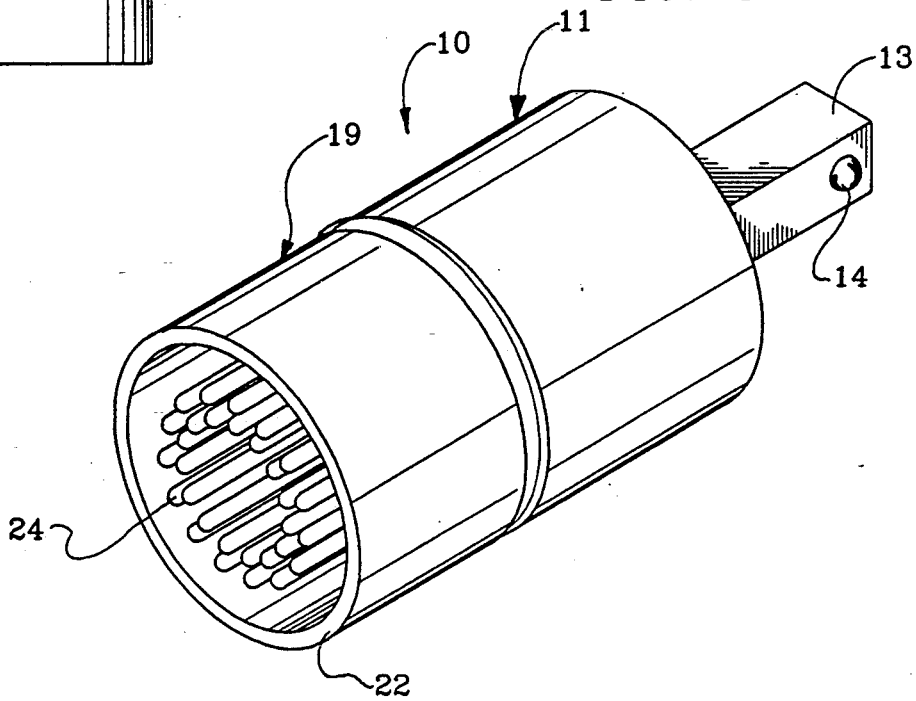
FIG. 5 is an isometric illustration of the instant invention.
Figures 6, 7, 8, 9, 10, 11, 12, 13, 14, 15, 16, 17, 18, 19, 20, 21:
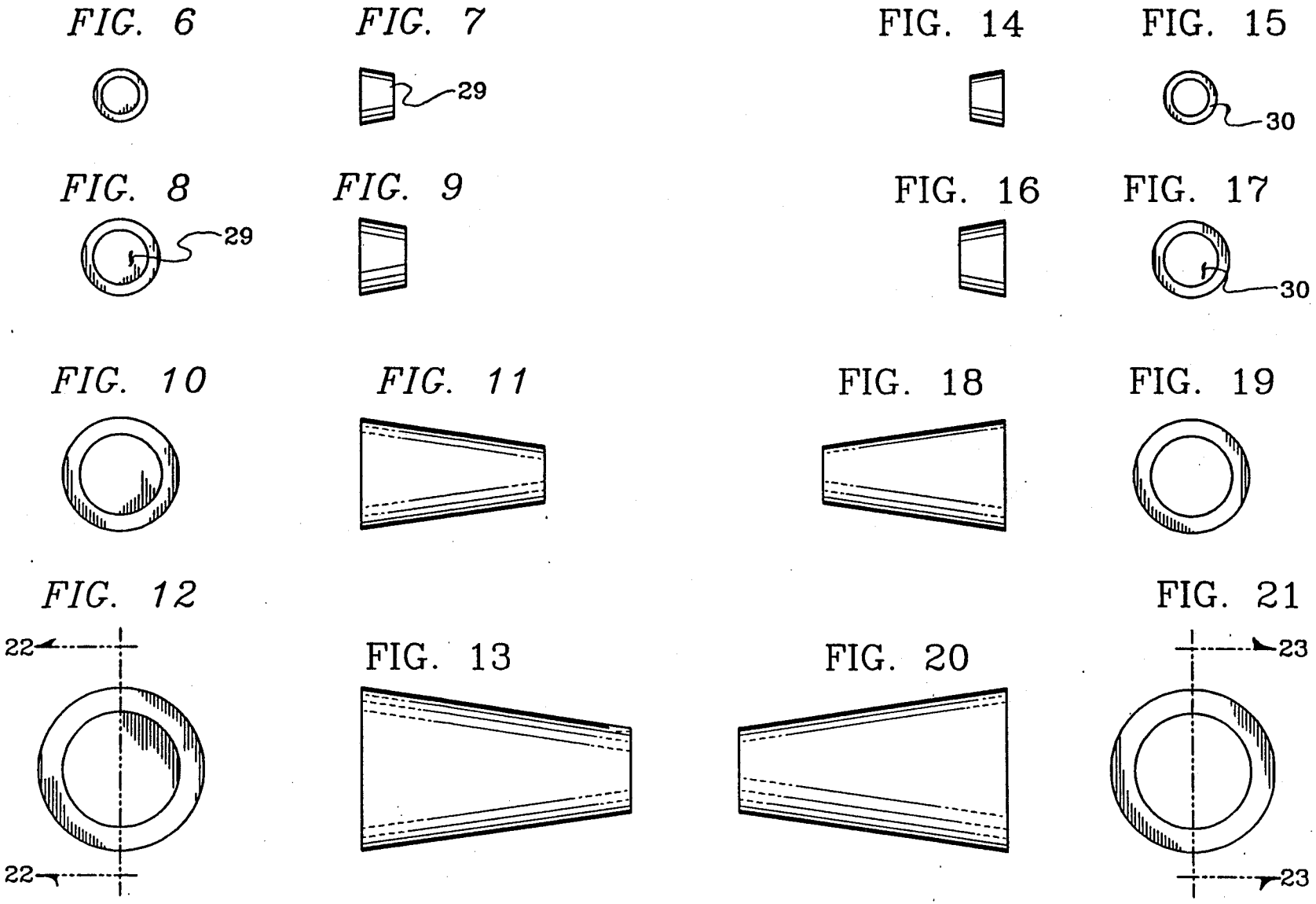
FIGS. 6, 8, 10, and 12 are bottom orthographic views of first cone inserts for utilization by the engaging pins of the invention.
FIGS. 7, 9, 11, and 13 are orthographic side views per the respective FIGS. 6, 8, 10, and 12.
FIGS. 14, 16, 18, and 20 are orthographic side views of second cone inserts for utilization by the invention.
FIGS. 15, 17, 19, and 21 are orthographic bottom views of the respective FIGS. 14, 16, 18, and 20.
Figure 23:
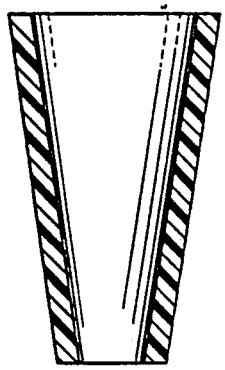
FIG. 23 is an orthographic view, taken along the lines 23—23 of FIG. 21 in the direction indicated by the arrows.
Figure 22:
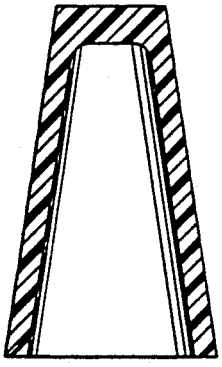
FIG. 22 is an orthographic view, taken along the lines 22—22 of FIG. 12 in the direction indicated by the arrows.
Figure 24:
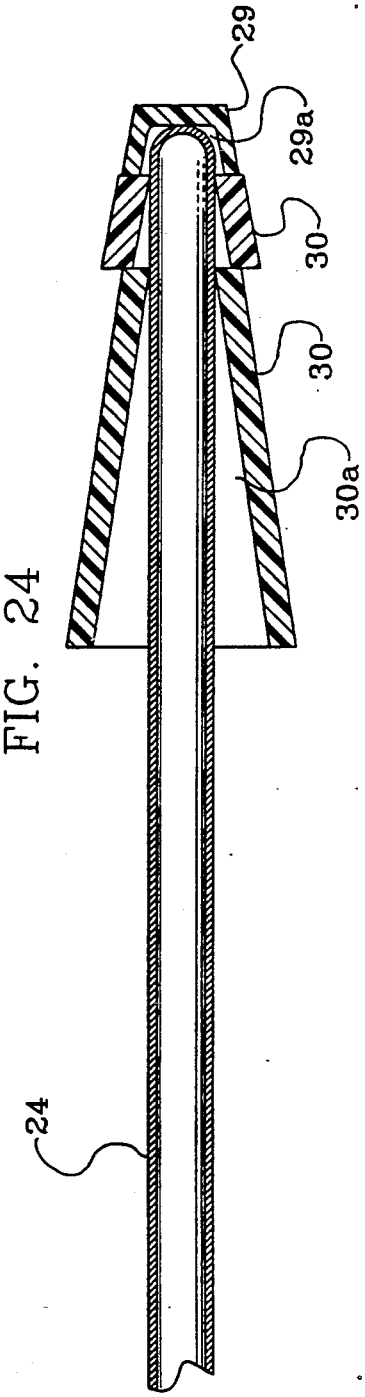
FIG. 24 is an orthographic side view, taken in cross-section, of the cone inserts mounted to an engaging pin.
Figure 25:
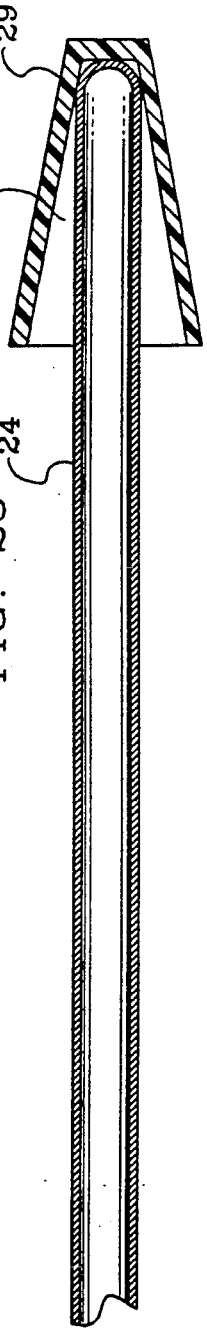
FIG. 25 is an orthographic side view of a first cone insert illustrative of mounting of the first cone insert relative to an engaging pin of the tool structure.

With reference now to the drawings, and in particular to FIGS. 1 to 25 thereof, a new and improved locking lug removal tool embodying the principles and concepts of the present invention and generally designated by the reference numeral 10 will be described.

More specifically, the locking lug removal tool 10 of the instant invention, with specific reference to the FIGS. 1-5, includes a first coaxially aligned housing defined along an axis 11*a* fixedly secured at a longitudinal relationship to a second coaxially aligned housing 19 further defined along the axis 11*a*. A first housing top wall 12 is spaced from and parallel a first housing bottom wall 16. The first housing top wall 12 includes a top wall lug 13 positioned medially of the top wall 12, including a spring-biased detent 14 contained therewithin radially directed through the lug 13 for securement to a driving tool (not shown). A first housing side wall 15 is arranged coaxially defined about the axis 11*a*, with a matrix of bottom wall bores 17 projecting coaxially into the first housing 11 from the first housing bottom wall 16 extending to and in an orthogonal relationship relative to the top wall 12 but terminating in a spaced relationship relative to the top wall 12. Each of the bottom wall bores 17 includes a bore spring 18, with an engaging pin head 25 positioned at a forward distal end of each spring 18, wherein each spring biases each engaging pin head 25 longitudinally of and exteriorly of each bore. Each engaging pin head 25 includes an coaxially aligned engaging pin 24 extending below each engaging head to project therefrom, in a manner to be described in more detail below.

The second housing 19 includes a second housing top wall 20 in a contiguous and coextensive relationship relative to the bottom wall 16, with a second housing cavity 21 extending into the second housing from a second housing bottom wall 22. The second housing cavity 21 terminates in a cavity floor 28 arranged in a parallel spaced relationship relative to the second housing bottom wall 22. A fastener 23 coaxially aligned with the axis 11*a* is directed through the cavity floor 28 into the second housing through the second housing bottom wall 16. The engaging head 25 is mounted with and its forward travel limited by a second housing first bore 26 coaxially aligned with a respective bottom wall bore 17. A second housing second bore 27 extends coaxially of the first bore 26 orthogonally through the cavity floor 28, wherein each engaging pin head 25 is of a second diameter greater than a first diameter defined by each engaging pin 24 that in a fully extended orientation is arranged within the cavity 21.

In use of the tool, the tool is merely directed onto a loking lug (not shown) of any desired configuration and the pins 24 are received within a cavity formed within such a locking lug and those pins not utilized are merely retracted within each associated bore 17.

The FIGS. 6-13 and the FIGS. 14-21 illustrate respective first and second cone inserts 29 and 30. The first cone inserts 29 each include a first cone conical cavity 29*a*, wherein the second cone inserts 30 include a through-extending second cone bore 30*a*. The cones are arranged for adhering relative to the engaging pins 24 adjacent to the engaging pins' free distal ends spaced from the engaging pin heads 25 to accommodate various geometric configurations within a locking lug member and thereby permit tailoring of the engaging pins relative to such structure. An example of such securement is illustrated in the FIGS. 4 and 25, with the engaging pins received within the bores 30*a* and the cavities 29*a* as required. Further, the inserts 29 and 30 when adhered to the pins 24 control depth of retraction of the pins relative to the bottom wall bores 17.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A locking lug removal tool, comprising, a first housing coaxially aligned about a predetermined axis with a second housing coaxially aligned about the predetermined axis fixedly mounted to the first housing, the first housing including a first housing top wall spaced from and parallel a first housing bottom wall, the second housing including a second housing top wall spaced from a second housing bottom wall, wherein the first housing top wall, the first housing bottom wall, the second housing top wall, and the second housing bottom wall are arranged in a parallel relationship, with the first housing bottom wall in contiguous and coextensive relationship relative to the second housing top wall, and the second housing bottom wall including a second housing cavity extending into the second housing from the second housing bottom wall and terminating in a cavity floor, wherein the cavity floor is arranged in a spaced parallel relationship relative to the second housing bottom wall, and a matrix of engaging pins are telescopingly received within the first housing extending through the second housing cavity floor, wherein each engaging pin of the matrix of engaging pins is contained within the second housing cavity.

2. A tool as set forth in claim 1 wherein the first housing bottom wall includes a matrix of bottom wall bores each having a bore floor and the bottom wall bores defined by a predetermined number and the matrix of engaing pins are defined by the predetermined number, wherein each bottom wall bore receives an engaging pin therewithin, and each bottom wall bore extends in a parallel relationship relative to one another and parallel to the predetermined axis, and each engaging pin includes a spring member captured between the engaging pin and said bore floor of one of said bottom wall bores.

3. A tool as set forth in claim 2 wherein the second housing includes a second housing first bore coaxially aligned with and coextensive with a respective bottom wall bore, and each first bore is coaxially aligned with an in communication with a second bore, wherein each first bore extends from the second housing top wall in a spaced relationship relative to the cavity floor, and the second bore extends from the first bore through the cavity floor, and each engaging pin includes an engaging pin head contained within one of said bottom wall bores and a coaxially aligned second bore, with an engaging pin extension extending from each head through the second bores and complementarily receives the engaging extension and the first bore complementarily receiving and engaging pin head of said engaging pin heads.

4. A tool as set forth in claim 3 including a fastener directed through the cavity floor and through the second housing top wall into the first housing coaxially aligned with the first housing and the second housing to secure the first housing and the second housing together in a releasable manner to permit servicing and replacement of said engaging pins.

5. A tool as set forth in claim 4 including at least one first cone insert, including a first cone cavity, and at least one second cone insert, wherein the second cone insert includes a through-extending second cone bore, and wherein the second cone insert and the first cone insert area arranged for securement to a free distal end of at least one of said engaging pins at a free distal end of said engaging pin.

* * * * *